US006273040B1

(12) United States Patent
Curtis

(10) Patent No.: US 6,273,040 B1
(45) Date of Patent: Aug. 14, 2001

(54) ADJUSTABLE OVERHEAD ROCKER CAM

(76) Inventor: William P. Curtis, 9403 Judge Ct., Spring Grove, IL (US) 60081

( * ) Notice: Subject to any disclaimer, the term of this patent is extended or adjusted under 35 U.S.C. 154(b) by 0 days.

(21) Appl. No.: 09/565,001

(22) Filed: May 4, 2000

(51) Int. Cl.[7] ..... F01L 13/00
(52) U.S. Cl. ..... 123/90.16; 123/90.39
(58) Field of Search ..... 123/90.15, 90.16, 123/90.39, 90.41

(56) References Cited

U.S. PATENT DOCUMENTS

| | | | | |
|---|---|---|---|---|
| 4,397,270 | * | 8/1983 | Aoyama | 123/90.16 |
| 5,189,998 | * | 3/1993 | Hara | 123/90.16 |
| 5,682,848 | | 11/1997 | Hampton et al. | 123/90.16 |
| 5,809,951 | * | 9/1998 | Kim | 123/90.16 |
| 5,979,379 | | 11/1999 | Sato et al. | 123/90.16 |
| 5,988,125 | | 11/1999 | Hara et al. | 123/90.16 |
| 6,085,705 | * | 7/2000 | Vorih | 123/90.12 |

* cited by examiner

*Primary Examiner*—Wellun Lo
(74) *Attorney, Agent, or Firm*—Gildo E. Fato

(57) ABSTRACT

Disclosed is an overhead rocker cam valve operating device for an internal combustion engine which is particularly useful for race cars or high performance automobiles. The device includes a rocker cam and connecting link, the link being adjustable within the rocker cam arm to provide for more of less power. Hence, the connecting link can be positioned closest to the cam lobe to provide for more power, performance and speed, or can be positioned farther from the cam lobe to provide for less power and fuel economy. The device can be made remotely adjustable by providing means engageable with the connecting link, such as a solenoid, whereby the link can be remotely positioned within the rocker cam arm.

11 Claims, 1 Drawing Sheet

ADJUSTABLE OVERHEAD ROCKER CAM

BACKGROUND OF THE INVENTION

FIELD OF THE INVENTION

The present invention relates to an adjustable overhead rocker cam valve operating device for an internal combustion engine and, in particular, to a device for use with race cars or high-performance automobile engines.

DESCRIPTION OF THE PRIOR ART

Prior valve control systems utilized fixed rocker arms which require considerable movement, or multiple rocker arm elements which are engageable with different cam profiles and means to interconnect the different rocker arm elements. An example is the system described in U.S. Pat. No. 5,623,897 issued Apr. 29, 1997. Other systems utilize a plurality of rocker arms positioned adjacent to one another, and a plurality of valve operating cams. Such a system is described in U.S. Pat. No. 5,979,379 issued Nov. 9, 1999.

SUMMARY OF THE INVENTION

In accordance with the principle of the present invention, there is provided an overhead rocker cam system which is adjustable and minimizes valve train movement. The system provides geometric advantages such that the rocker arm does not move away from the valve stem in an excessive manner. The rocker cam is adjustable so that the farther away the link is moved from the rocker cam, the less extra lift is provided. Thus, the rocker cam and connecting link can be adjusted for more or less power or, with a performance-type automobile, can be adjusted to a performance mode or an economy mode.

DETAILED DESCRIPTION OF THE PREFERRED EMBODIMENTS

The present invention is described with reference to the embodiments illustrated in the accompanying drawings. It should be understood, however, that no limitation of the scope of the invention is intended. Such alterations and modifications of the illustrated devices utilize the principles of the invention as illustrated and described herein, and would occur to one skilled in the art to which the invention pertains.

Figure 1:
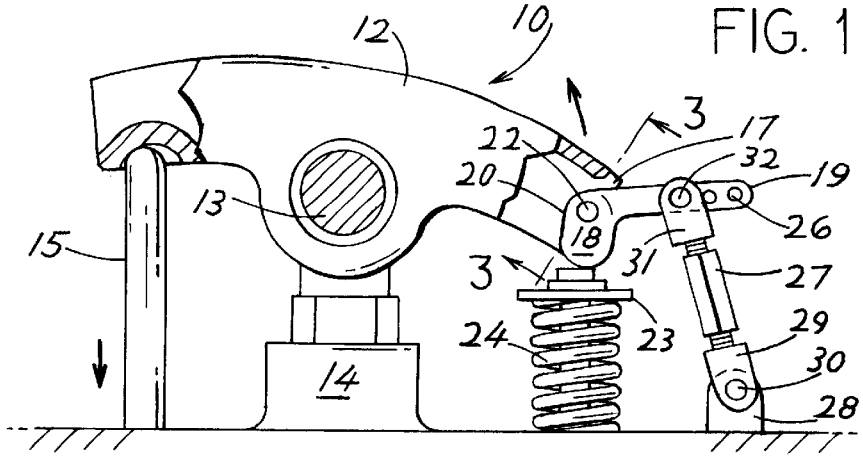
FIG. 1 is a side-elevational view of the overhead rocker cam system of the present invention when the rocker arm is at the full-lift position.
Figure 2:
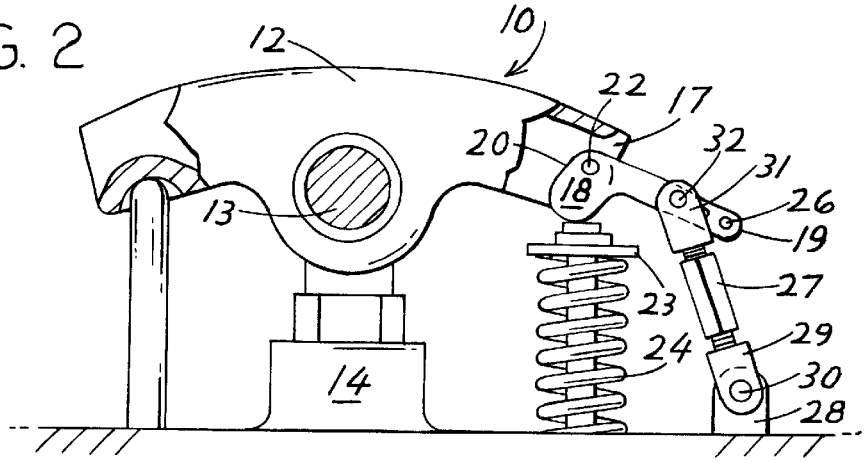
FIG. 2 is a side-elevational view of the overhead rocker cam system of the present invention when the rocker arm is at the at-rest position.

A first embodiment of the present invention is described with reference to FIGS. 1 and 2. FIG. 1 illustrates an overhead rocker cam device 10 of the present invention at the full-lift or actuated position. The device 10 comprises a pivoted rocker arm 12, pivoted on a rod 13. The rocker arm

12 is mounted on a base 14 and is actuated by a push rod 15 connected to a camshaft (not shown). At the proximal end 17 of the rocker arm 12 is positioned a rocker cam 18 comprising a cam arm 19 and a cam lobe 20. The rocker cam 18 is pivoted on a pin 22 and actuates a valve 23 and spring 24. The cam arm 19 of the rocker cam 18 includes two or more openings 26 so that the rocker cam 18 can be operatively connected to the link 27. The link 27 is pivoted to a base 28 by means of a pin 30 with the end 31 being adjustable with reference to the rocker cam 18. The end 31 of the link 27 includes a removable pin 32 so that the end 31 of the link 27 can be positioned in any of the openings 26. The distal end 29 of the link 27 can be movably mounted on the base 28; one embodiment illustrated in FIGS. 1 and 2, being rotatably mounted by means of pin 30.

This embodiment is particularly suited for a racing automobile, for example, to which adjustments can be made to the engine without the necessity of changing cams. By moving the link 27 closer to the cam lobe 20, more actuation is obtained with quicker opening and closing rate of the valve 23 resulting in more valve lift and duration with consequently more power. By moving the link 27 farther away from the cam lobe 20, less actuation is obtained with consequently less power. Such adjustments can be made quickly, as noted, without having to change cams, which is advantageous if adjustments are necessary during a race.

Figure 4:
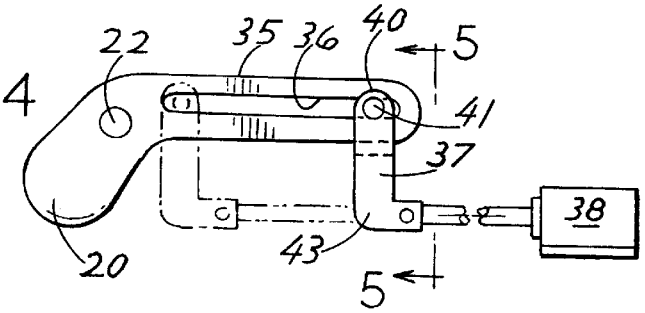
FIG. 4 is a side-elevational view of one embodiment of the rocker cam for use with a solenoid-operated link for remotely adjusting the rocker cam.
Figure 3:
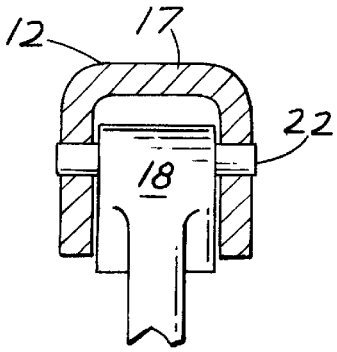
FIG. 3 is a partial end view of the rocker cam system of the present invention taken along line 3—3 of FIG. 1.
Figure 5:
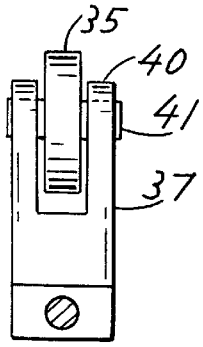
FIG. 5 is an end view of the embodiment of FIG. 4 taken along line 5—5 of FIG. 4.

FIG. 4 illustrates an embodiment intended for use particularly with a performance-type automobile. In this embodiment, the rocker cam 18 is substituted by the rocker cam 35 of FIG. 4. Like the rocker cam 18 of FIGS. 1 and 2, the rocker cam 35 of FIG. 4 includes the lobe 20 and is pivoted on a pin 22. However, instead of the openings 26 of the rocker cam 18 of FIGS. 1 and 2, the rocker cam 35 of FIG. 4 includes a slot 36 interconnected with a link 37 which in turn is attached to a solenoid 38. The end 40 of the link 37 can be shaped into the form of a fork or clevis with a pin 41 positioned in the slot 36, connecting the link 37 with the rocker cam 35. The distal end 43 of the link 37 of FIG. 4, as illustrated, is connected to the solenoid 38.

In this embodiment, adjustments can be made by a remote control (not shown) which activates the solenoid 38. Two positions can be utilized, a performance mode in which the link 37 is positioned closest to the cam lobe 20 and an economy mode in which the link 31 is positioned farthest from the cam lobe 20. Thus, the driver can adjust the rocker cam 35 for performance and speed or for economy such as for city driving. As previously described, in the performance mode, when the link 37 is positioned closest to the cam lobe 20, more actuation of the valve 23 is obtained with consequently more valve lift and power. Likewise, when the link 37 is positioned further from the cam lobe 20, less actuation is obtained, with less power, and thus, more economy in fuel consumption.

Hence, the overhead rocker cam device 10 of the present invention has a number of advantages in addition to being adjustable. For example, it minimizes valve train movement, which in turn minimizes wear and tear. Previous systems, with fixed rocker arms, required more movement; namely the valve stem travels linearly while the rocker arm travels in a circular manner. With the system of the present invention, the rocker arm 12 moves away from the valve 23 while the rocker cam 18 moves toward the valve. This results in changes in geometry from the rocker arm to the valve stem since valve lift and duration is achieved not only from the primary cam shaft but also from the rocker cam 18. Another benefit of the described device and system is that the same valve lift used in previous systems is obtained with a smaller camshaft, saving important space and weight in a racecar.

Although the preferred embodiments of the present invention have been illustrated and described in the foregoing description, it is understood that changes and modifications within the scope of the invention, as defined in the following claims, are included.

What is claimed is:

1. An adjustable rocker cam device for an internal combustion engine including a push rod, cam shaft and engine valve, said device comprising:

a rocker arm pivotally mounted on a base, one end of said rocker arm adapted for engagement with the push rod, and having a distal end;

a rocker cam pivotally mounted on the distal end of the rocker arm and including a lobe for engagement with the valve and an arm extending from the lobe, the arm including one or more openings therein; and a link, one end of said link being receivable in one of said one or more openings in the rocker cam arm, the distal end thereof being adapted for movement.

2. The adjustable rocker cam device of claim 1 wherein the cam arm includes one or more separate openings therein for receiving the link, the distal end of the link being movably mounted on a base.

3. The adjustable rocker cam device of claim 2 wherein the cam arm includes at least two separate openings for receiving the link, the link being selectably adjustable to the opening closest to the cam lobe to provide greater engine power and being selectably adjustable to the opening farther from the cam lobe to provide greater fuel economy.

4. The adjustable rocker cam device of claim 3 wherein the distal end of the link is pivotally mounted on the base.

5. The adjustable rocker cam device of claim 1 wherein the cam arm includes an extended slot for movably receiving one end of the link, and means engageable with the distal end of the link and adapted to move the end of the link within the slot to different positions within the slot.

6. The adjustable rocker cam device of claim 5 wherein the end of the link within the slot is movable to one of two positions within the slot, one position closest to the cam lobe to provide more engine power and a second position farthest from the cam lobe to provide greater fuel economy.

7. The adjustable rocker cam device of claim 6 wherein the means engageable with the distal end of the link is engageable with the link and remotely controllable to adjustably position the end of the link within the slot in the cam arm to one of two positions within the slot in the cam arm.

8. The adjustable rocker cam device of claim 7 wherein the means engageable with the distal end of the link comprises a solenoid.

9. An adjustable rocker cam device for an internal combustion engine including a push rod, cam shaft and engine valve, said device comprising:

a rocker arm pivotally mounted on a base, one end of said rocker arm adapted for engagement with the push rod, and having a distal end;

a rocker cam pivotally mounted on the distal end of the rocker arm and including a lobe for engagement with the valve and an arm extending from the lobe, the arm including at least two spaced-apart openings therein; and a link, one end of said link being removably receivable in one of the openings in the rocker cam arm, the distal end thereof being pivotally mounted on the base whereby the link is selectably adjustable to the opening closest to the cam lobe to provide greater engine power and to the opening farthest from the cam lobe to provide greater fuel economy.

10. An adjustable rocker cam device for an internal combustion engine including a push rod, cam shaft and engine valve, said device comprising:

a rocker arm pivotally mounted on a base, one end of said rocker arm adapted for engagement with the push rod, and having a distal end;

a rocker cam pivotally mounted on the distal end of the rocker arm and including a lobe for engagement with the valve and an arm extending from the lobe, the arm including an extended slot therein; and a link, one end of said link being adjustably receivable in the extended slot in the rocker cam arm, the distal end thereof being pivotally mounted on the base whereby the link is selectably adjustable to one of two positions within the slot, the position closest to the cam lobe to provide greater engine power and the position furthest from the cam lobe to provide greater fuel economy.

11. The adjustable rocker cam device of claim 10 wherein the distal end of the link is engageable with a remotely controllable solenoid to adjustably position the end of the link within the slot in the cam arm to said one of two positions within the slot.

* * * * *